US011261504B2

(12) United States Patent
Luo et al.

(10) Patent No.: US 11,261,504 B2
(45) Date of Patent: Mar. 1, 2022

(54) METHOD FOR PRODUCING ULTRA-HIGH-STRENGTH MARTENSITIC COLD-ROLLED STEEL SHEET BY ULTRA RAPID HEATING PROCESS

(71) Applicant: University of Science and Technology Beijing, Beijing (CN)

(72) Inventors: Haiwen Luo, Beijing (CN); Pengyu Wen, Beijing (CN)

(73) Assignee: University of Science and Technology Beijing, Beijing (CN)

( * ) Notice: Subject to any disclaimer, the term of this patent is extended or adjusted under 35 U.S.C. 154(b) by 301 days.

(21) Appl. No.: 16/252,908

(22) Filed: Jan. 21, 2019

(65) Prior Publication Data

US 2019/0153558 A1 May 23, 2019

Related U.S. Application Data

(63) Continuation of application No. PCT/CN2018/105128, filed on Sep. 12, 2018.

(30) Foreign Application Priority Data

Oct. 26, 2017 (CN) ..... 201711019854.4

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2003/0047256 A1 3/2003 Kami et al.
2010/0132854 A1* 6/2010 Cola, Jr. ..... C21D 1/08 148/575
(Continued)

FOREIGN PATENT DOCUMENTS

CN 102644021 A 8/2012
CN 102925790 A 2/2013
(Continued)

OTHER PUBLICATIONS

Reis et al., "Grain Refinement and Texture Change in Interstitial Free Steels after Severe Rolling and Ultra-short Annealing", ISIJ International, vol. 43 (2003), No. 8, pp. 1260-1267 (Year: 2003).*
(Continued)

*Primary Examiner* — Alexandra M Moore
*Assistant Examiner* — Christopher D. Moody

(57) ABSTRACT

A method for producing ultra-high strength martensitic cold-rolled steel sheet adopts pulsed ultra-rapid heating of cold-rolled martensitic steel sheets after smelting, solidification, hot rolling, billet or ingot casting, as well as conventional manufacturing processes such as hot continuous rolling and winding, pickling, and room temperature cold rolling. The steel sheets are rapidly heated at a heating rate of 100-500° C./s to a single-phase region of austenite, and then the samples are immediately water-cooled to obtain martensite structure without undergoing heat preservation or a very short holding time. The tensile strength of the martensitic steel is in the range of 1800-2300 MPa, and the total elongation can reach 12.3%. Compared with the continuous annealing product of the same martensitic steel, the
(Continued)

tensile strength is increased by 700 MPa or more, and the maximum increase of total elongation is 6%.

3 Claims, 5 Drawing Sheets

(51) Int. Cl.

| | |
|---|---|
| ***C21D 6/00*** | (2006.01) |
| ***C22C 38/54*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/04*** | (2006.01) |
| ***C22C 38/02*** | (2006.01) |
| ***C22C 38/00*** | (2006.01) |

(52) U.S. Cl.
CPC ..... *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/008* (2013.01)

(56) References Cited

U.S. PATENT DOCUMENTS

| | | | | |
|---|---|---|---|---|
| 2012/0237390 | A1 | 9/2012 | Jeong et al. | |
| 2015/0027593 | A1* | 1/2015 | Hata | C22C 38/04 148/504 |
| 2018/0371586 | A1* | 12/2018 | Cho | C21D 8/0247 |
| 2019/0008207 | A1 | 1/2019 | Crowe | |

FOREIGN PATENT DOCUMENTS

| | | | |
|---|---|---|---|
| CN | 106636925 | A | 5/2017 |
| CN | 107127212 | A | 9/2017 |

OTHER PUBLICATIONS

Castro Cerda et al., "The effect of the pre-heating stage on the microstructure and texture of a cold rolled FeCMnAlSi steel under conventional and ultrafast heating", Materials Characterization 130 (2017) 188-197 (Year: 2017).*

* cited by examiner

METHOD FOR PRODUCING ULTRA-HIGH-STRENGTH MARTENSITIC COLD-ROLLED STEEL SHEET BY ULTRA RAPID HEATING PROCESS

CROSS-REFERENCE TO RELATED APPLICATIONS

This application is a continuation of International Patent Application No. PCT/CN2018/105128 with a filing date of Sep. 12, 2018, designating the United States, and further claims priority to Chinese Patent Application No. 201711019854.4 with a filing date of Oct. 26, 2017. The content of the aforementioned applications, including any intervening amendments thereto, are incorporated herein by reference.

FIELD OF TECHNOLOGY

This patent for an invention relates to the technical field of metal heat treatment, in particular to a method for producing ultra-high strength martensitic cold-rolled steel sheet by an ultra-rapid heating process.

BACKGROUND

Low carbon steel with martensite microstructure is an important representative of advanced high-strength-steel (AHSS) in the field of steel materials. Its tensile strength is generally in the range of 900-1500 MPa, which can be mainly used for high-strength application parts on automobiles such as side collision protection of vehicles and bumpers. At present, the steel industry is faced with the demand for improved product performance to ensure safety. At the same time, the car bodies are required to be lightweight to reduce energy consumption standards and reduce pollutant emissions, thereby meeting the corresponding requirements of energy conservation and environmental protection.

Now the production of cold rolled martensite steel (less than 2 mm), is produced by continuous annealing process after cold rolling, and the annealing time is more than 3 minutes. Due to the limitation of the length of the production line, the annealing time does not exceed 10 min. Compared with the hood annealing with a slow heating rate, the heating rate of continuous annealing is significantly faster, and the annealing temperature of the steel sheet can be accurately controlled. The relatively high heating rate during continuous annealing can delay the recrystallization process, therefore whereby the deformation energy storage accumulated by cold rolling deformation can accelerate the austenite reverse transformation, and can obtain suitable size austenite grains in a short time and then martensite is formed after cooling.

In the past ten years, thanks to the development of transverse flux induction heating technology, ultra-fast pulse heating can be achieved. The annealing process of the present invention, unlike the conventional continuous annealing, is followed by water cooling immediately after using ultra-rapid heating to heat the cold-rolled steel sheet to austenite single-phase region in a very short time without heat preservation or extremely short holding time (<5 s). The annealing time can be shortened to several seconds, by producing a cold-rolled martensitic steel by an ultra-rapid heating process. Moreover, the strength exceeds the martensite steel produced by the continuous annealing process, achieving ultra-high strength, thereby increasing the efficiency and energy-saving of the heat treatment process to an unprecedented level. In addition, the preheating process is adopted in the front part of the rapid heating, which can avoid the distortion of the heat treatment process of the large steel plate.

BRIEF DESCRIPTION

The technical problem to be solved by the present patent for an invention is to provide an ultra-high-speed heating process for producing ultra-high-strength martensitic cold-rolled steel sheets, which reduces annealing time, greatly improves production efficiency, reduces energy consumption, and further improves strength. The present invention takes the conventional cold-rolled steel plate as the initial microstructure, which is mainly composed of pearlite and ferrite microstructure with cold deformation. The cold-rolled steel sheet may be preheated, that is, heated to a range of 300-500° C. at a heating rate of 1-10° C./s, and then the cold-rolled steel sheet is heated to austenite single-phase zone at a heating rate of 100-500° C./s, the sheet can also be heated directly to the austenite single-phase zone at heating rate of 100-500° C./s without preheating, and then water cooled to room temperature after heated preservation 0-5 s. This process can not only shorten the production cycle to several seconds, but also can achieve a higher strength than the continuous annealing product. The tensile strength reaches 1800-2300 MPa, which increases the efficiency and energy saving of the heat treatment process to an extremely high level. At present, the heating rate in the range of 100-500° C./s can be achieved by the application of the transverse flux induction heating technology, and thus the feasibility of industrial production is also exists. The mechanism of ultra-rapid heating to improve performance is mainly due to the fact that rapid heating delays the recrystallization of cold-rolled deformed microstructure, thereby maintaining the deformation storage energy and deformation structure to a greater extent, accelerating the austenite reverse transformation kinetics, especially promoting the austenite nucleation and a large amount of fine martensite structure can be obtained after water cooling, thereby greatly increasing the tensile strength.

In one embodiment, a method includes the following steps:

(1) smelting and solidification of steel: steelmaking by converter, electric furnace or induction furnace, production of ingot by continuous casting to produce slab or die casting;

(2) hot rolling after slab casting or ingot casting: the slab or ingot obtained in step (1) is heated by 1050-1250° C., and rolled by rough rolling mill and hot strip rolling mill to 2.5-15 mm thickness, batched at 500-700° C.;

(3) subjecting the continuous hot-rolled strip obtained after the coiling in step (2) to pickling treatment, and then directly subjected to cold rolling to 0.5-2 mm at room temperature;

(4) subjecting the cold-rolled steel sheet obtained in the step (3) to an ultra-rapid heating process, heating the cold-rolled steel sheet to 300-500° C. at a heating rate of 1-10° C./s, and then reheating at a heating rate of 100-500° C./s to austenite single-phase zone 850-950° C.; or rapid heating of the sample to the austenite single-phase zone directly at a heating rate of 100-500° C./s without preheating process and control the final temperature of 850-950° C.; either the heating process, water cooling the steel sheet immediately after incubation of less than 5s, an ultra-high strength cold-rolled steel sheet is obtained.

According to the method, the thickness of the cold rolled steel sheet obtained in the step (3) is less than 2 mm.

The chemical composition of the slab or ingot obtained in the step (1) is 0.1-0.3 wt. % C, 0.5-2.5 wt. % Mn, 0.05-0.3 wt. % Si, 0.05-0.3 wt. % Mo, 0.01-0.04 wt. % Ti, 0.1-0.3 wt. % Cr, 0.001-0.004 wt. % B, P≤0.020 wt. %, S≤0.02 wt. %, and the balance is Fe and unavoidable impurities.

The ultra-rapid heating process in the step (4) is performed by electric resistance or magnetic induction channel heating.

The steel sheet prepared by the ultra-rapid heating process in the step (4) has a microstructure characterized by martensite microstructure and may retain a small amount of ferrite, bainite, and carbide, and may also retain some deformed structure. The yield strength of the steel sheet prepared by the ultra-rapid heating process in the step (4) is ≥1100 MPa, the tensile strength is 1800-2300 MPa, the total elongation is 12.3%, and the uniform elongation reaches 5.5-6%. The preheating process in step (4) can prevent the distortion of the large cold-rolled steel sheet during the heat treatment process, but after the preheating process is cancelled, the ultra-rapid heating process can directly improve the performance.

Adding one or more of the following elements to the casting blank or the ingot prepared in the step (1) can obtain the similar performance or even further improve the performance: Ni: 0.1-3.0 wt. %, Cu: 0.5-2.0 wt. %, Nb: 0.02-0.10 wt. %, [N]: 0.002-0.25 wt %, V: 0.02-0.35 wt. %, RE (rare earth): 0.002-0.005 wt. %, Ca: 0.005-0.03 wt. %. The addition of Ni can further improve the hardenability or low-temperature impact toughness of the steel; adding Nb, V etc. can refine the prior austenite grains to cause final microstructure refinement; adding Cu, V, etc. to increase the strength of the steel by precipitation strengthening; adding [N] to adjust the stability of austenite.

The beneficial effect of the above technical solution of the present invention is as follows:

In the above scheme, different from the continuous annealing process of martensite cold-rolled steel sheet with low heating rate and long annealing time, the process adopts cold rolling initiation structure, adopts preheating or non-preheating method, heating the sample to a single austenite zone by increasing the heating rate to 100-500° C./s. The holding time is not more than 5 s, and can greatly retain the deformation structure, promote austenite nucleation and accelerate the austenite reverse phase transformation. After water cooling a fine martensite structure is obtained, which significantly increases the strength while the process efficiency is maximized.

DETAILED DESCRIPTION

Figure 1:
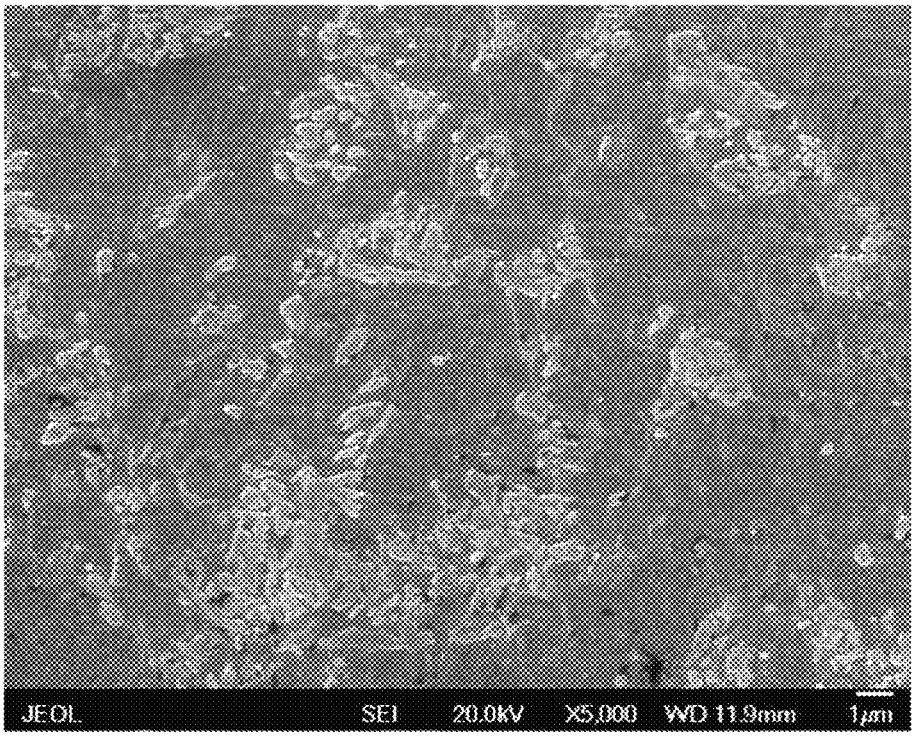
FIG. 1 is a schematic diagram of the initial microstructure of a 1.4 mm thickness martensite cold-rolled steel plate in an embodiment of the present patent for an invention.

In order to make the technical problems, the technical solutions and advantages of the present patent for an invention clearer, the detailed description will be made below in conjunction with the appended drawings and a specific embodiment.

Generally, an embodiment provides a method for producing an ultra-high strength martensitic cold-rolled steel sheet by an ultra-rapid heating process, the method comprising the following steps of:

(1) smelting and solidification of steel: steelmaking by converter, electric furnace or induction furnace, production of ingot by continuous casting to produce slab or die casting;

(2) hot rolling after slab casting or ingot casting: the slab or ingot obtained in step (1) is heated by 1050-1250° C., and rolled by rough rolling mill and hot strip rolling mill to 2.5-15 mm thickness, batched at 500-700° C.;

(3) subjecting the continuous hot-rolled strip obtained after the coiling in step (2) to pickling treatment, and then directly subjected to cold rolling to 0.5-2 mm at room temperature;

(4) subjecting the cold-rolled steel sheet obtained in the step (3) to an ultra-rapid heating process, heating the cold-rolled steel sheet to 300-500° C. at a heating rate of 1-10° C./s, and then reheating at a heating rate of 100-500° C./s to austenite single-phase zone 850-950° C.; or rapid heating of the sample to the austenite single-phase zone directly without preheating process and control the final temperature of 850-950° C.; either the heating process, water cooling the steel sheet immediately after incubation of less than 5 s, an ultra-high strength cold-rolled steel sheet is obtained.

Various embodiments will be better understood when read in conjunction with the appended drawings and tables.

TABLE 1

Chemical composition of ultra-rapid heated martensite cold-rolled steel sheet (wt. %)

| Grade of steel | C | Si | Mn | Mo | Cr | Ti | B | Fe |
|---|---|---|---|---|---|---|---|---|
| MS1500 | 0.18 | 0.28 | 1.5 | 0.15 | 0.13 | 0.04 | 0.002 | Bal. |

Various embodiments provide a method for producing an ultra-high strength martensitic cold-rolled steel sheet via an ultra-rapid heating process. TABLE 1 shows the chemical composition of the hot rolled product is obtained by converter, continuous casting and hot continuous rolling. Then the hot rolling sheet is performed after pickling treatment, and cool rolling to a 1.4 mm thick, which has a pearlite+ferrite microstructure with serious cold deformation. The mechanical properties of tensile strength of 1530 MPa, yielding of 1100 MPa and total elongation of 6.5% can be obtained by continuous annealing of the cold-rolled sheet at 900° C. for 3 minutes; however, the test sample with preheating and ultra-rapid heating to 900° C. following by water cooling can achieve a tensile strength of 2257 MPa, a total elongation of 10.2%, and the yield strength is also as high as 1115 MPa. Specifically, the ultra-rapid heating experiment is carried out on a thermal simulation test machine by a preheating process, and the cold-rolled sample is heated to 400° C. at a heating rate of 5° C./s by resistance. Then, it is heated to a temperature of 850-950° C. at a heating rate of 300° C./s, and the water cooling is immediately executed after being kept at different times within 0-5 s. Comparing the performance of the ultra-rapid heating and the continuous sample by TABLE 2, it is found that the tensile strength of the ultra-rapid heating sample increased by more than 700 MPa, and the elongation increased by 3.7%, even on the sample heated to a final temperature of 950° C., it can reach 5.8%. In addition, it can be found that the extension of isothermal time will lead to a reduction of tensile strength. In particular, the cold-rolled steel sheet is heated to 900° C. and 950° C. then quenching without insulation wins the highest tensile strength and good elongation.

The corresponding mechanical properties of the cold-rolled martensitic steel sheet which is directly heated to the final temperature with a heating rate of 300° C./s without preheating, followed by water cooling without heating preservation, are also given in TABLE 2. It can be found that the strength of the steel plate can be further improved after the preheating is cancelled, and the tensile strength at the final temperature of 900° C. and 950° C. approaches or exceeds 2.3 GPa, while the plasticity is not impaired.

Figure 2:
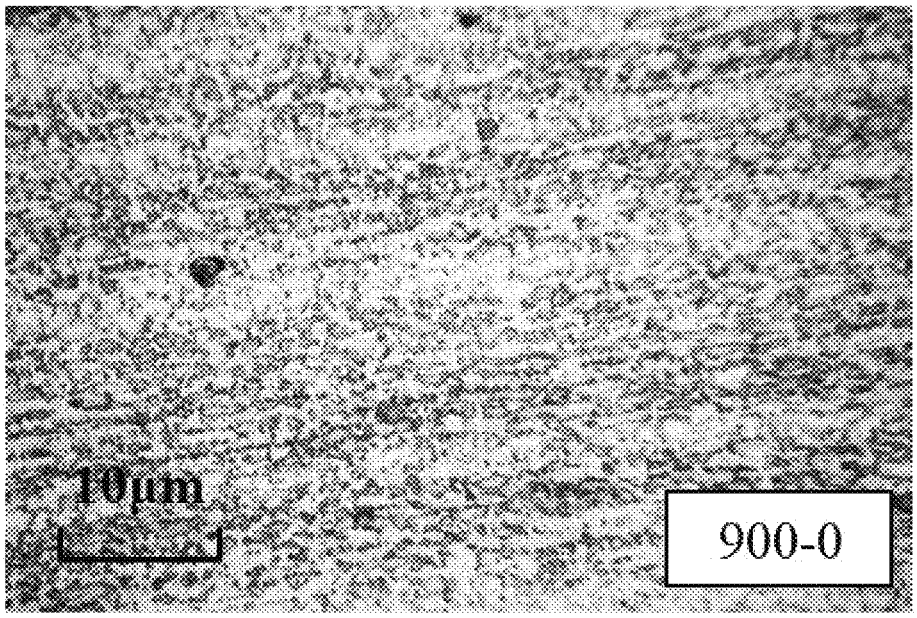
FIG. 2 is an optical micrograph of a sample cooled by a martensitic cold-rolled steel sheet heated to 400° C. at a heating rate of 5° C./s, and then heated to 900° C. at a heating rate of 300° C./s holding for 0.5 s to an embodiment of the present patent for an invention.
Figure 3:
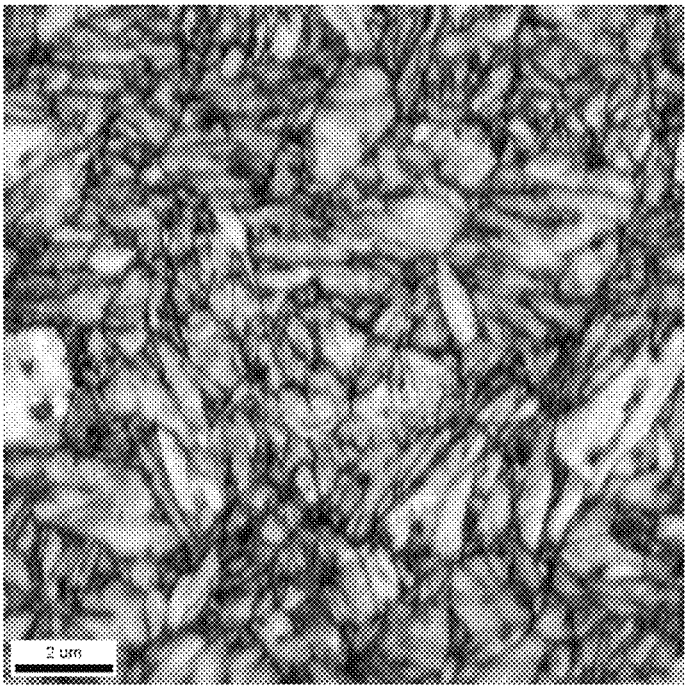
FIG. 3 is an EBSD (electron backscatter diffraction) Image Quality photo of a sample cooled by a martensitic cold-rolled steel sheet heated to 400° C. at a heating rate of 5° C./s, and then heated to 900° C. at a heating rate of 300° C./s holding for 0.5 s in an embodiment of the present patent for an invention.
Figure 4:
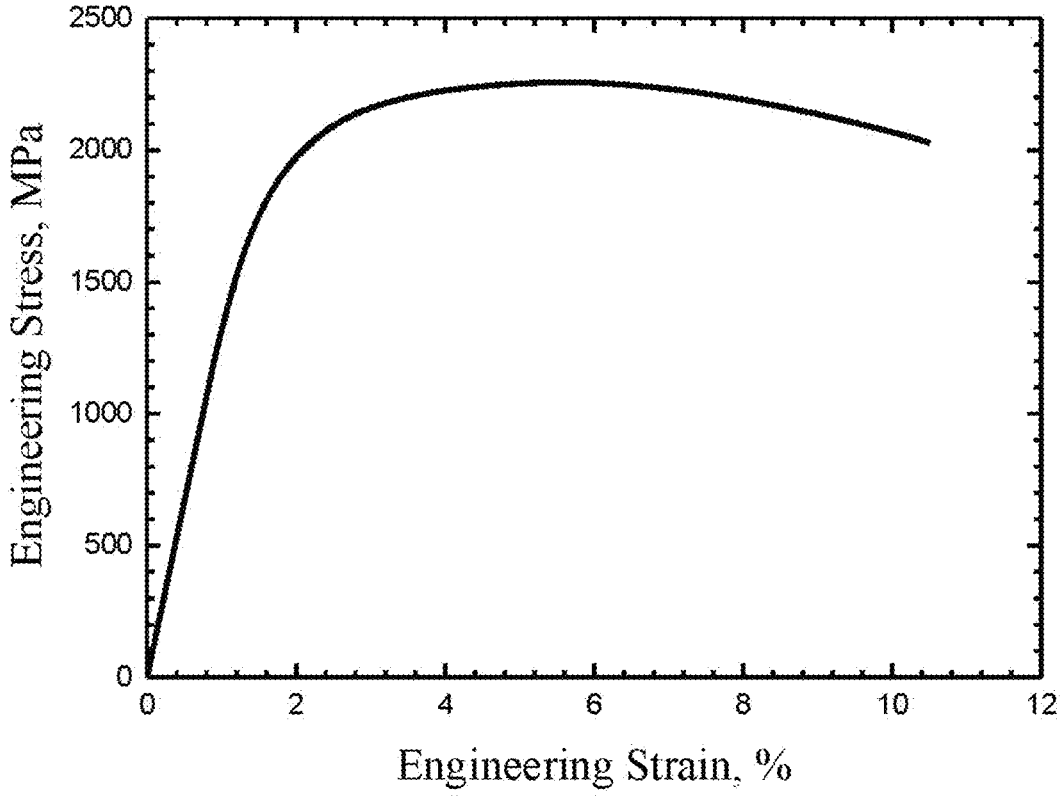
FIG. 4 is a tensile curve of a sample cooled by a martensitic cold-rolled steel sheet heated to 400° C. at a heating rate of 5° C./s, and then heated to 900° C. at a heating rate of 300° C./s holding for 0.5 s in an embodiment of the present patent for an invention.
Figure 5:
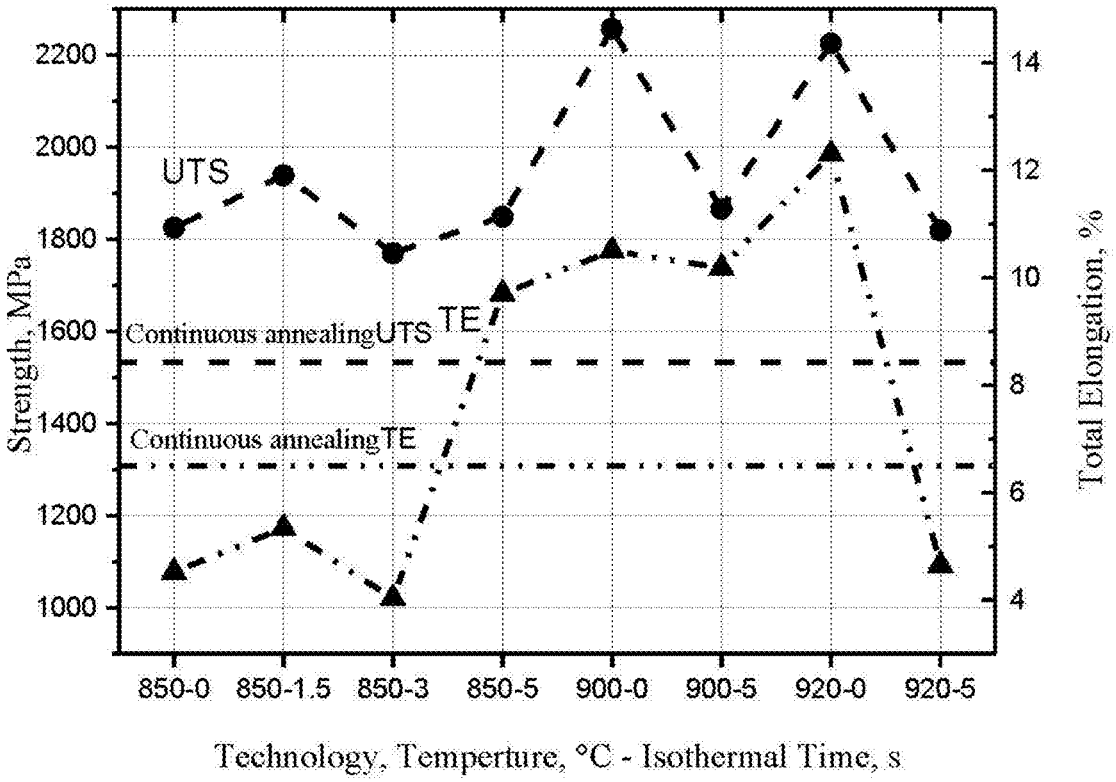
FIG. 5 is a summary of the mechanical properties of a sample obtained by ultra-rapid heat treatment of a martensitic cold-rolled steel sheet according to an embodiment of the present patent for an invention.

FIG. 1 shows that the microscopic structure of this grade of the cold-rolled steel is mainly pearlite+ferrite with serious cold deformation. The optical micrograph of the sample which is preheated and ultra-rapid heated to 900° C. is showed in FIG. 2. It can be seen that there are fine original austenite grain boundaries in the microstructure, and a large number of them are less than 1 μm in size; from the Image quality image of electron backscatter diffraction (EBSD), showed in FIG. 3, the microstructure is mainly martensite, which includes a large number of martensite laths and martensite blocks. FIG. 4 shows the tensile curve under the current process, the ultra-rapid heated sample had more excellent tensile strength and uniform elongation. FIG. 5 is the summary of the mechanical properties under ultra-rapid heating. It can be knew that the best balance of mechanical properties could be obtained when the temperature raised to the range of 900-950° C. The sample has a higher tensile strength at 900° C. and a better plasticity at 950° C., besides, the steel plate without isothermal treatment has better mechanical properties. It can be concluded that this method has great technological advantages and is expected to be put into actual production.

TABLE 2

Mechanical properties of ultra-fast heated and continuous retreated process cold-rolled martensitic steel sheets

| Heating technology | Heating temperatures (° C.) and holding times (s) | Tensile strength, MPa | Yield strength, MPa | The total elongation, % | Uniform elongation, % |
|---|---|---|---|---|---|
| Heating to 400° C. at rate of 5° C./s, then heating at rate of 300° C./s | 850-0 | 1825 | 1145 | 4.52 | 4.17 |
| | 850-1 | 1939 | 1173 | 5.34 | 5.03 |
| | 850-3 | 1770 | 1225 | 4.03 | 4.03 |
| | 850-5 | 1849 | 1195 | 9.7 | 3.85 |
| | 900-0 | 2257 | 1115 | 10.5 | 6.02 |
| | 900-5 | 1866 | 1195 | 10.18 | 6.01 |
| | 950-0 | 2225 | 1235 | 12.34 | 5.56 |
| | 950-5 | 1819 | 1260 | 4.65 | 3.82 |
| Heating directly at rate of 300° C./s from room temperature | 850-0 | 1950 | 1255 | 9.13 | 4.86 |
| | 900-0 | 2325 | 1270 | 11.32 | 5.65 |
| | 950-0 | 2290 | 1310 | 12.60 | 5.95 |
| Healing of continuous annealing process | 900-180 | 1530 | 1100 | 6.5 | — |

The written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

We claim:

1. A method for producing ultra-high-strength martensitic cold-rolled steel sheet via an ultra-rapid heating process, comprising the steps of:

(1) smelting of steel: steelmaking by converter, electric furnace or induction furnace; solidification of steel: production of ingot by continuous casting to produce slab or die casting, wherein the chemical composition of the slab or ingot obtained contains 0.1-0.3 wt. % C, 0.5-2.5 wt. % Mn, 0.05-0.3 wt. % Si, 0.05-0.3 wt. % Mo, 0.01-0.04 wt. % Ti, 0.1-0.3 wt. % Cr, 0.001-0.004 wt. % B, P≤0.020 wt. %, S≤0.02 wt. %, and the balance is Fe and unavoidable impurities;

(2) hot rolling after the slab casting or ingot casting: the slab or ingot obtained in step (1) is heated to 1050-1250° C., and rolled by a rough rolling mill and a hot strip rolling mill to 2.5-15 mm thickness, coiling at 500-700° C.;

(3) subjecting a continuous hot-rolled strip obtained after the coiling in step (2) to a pickling treatment, and then directly subjected to cold rolling to 0.5-2 mm at room temperature;

(4) subjecting a cold-rolled steel sheet obtained in step (3) to an ultra-rapid heating process, heating the cold-rolled steel sheet to 300-500° C. at a heating rate of 1-10° C./s, and then reheating at a heating rate of 100-500° C./s to an austenite single-phase zone of 850-950° C., then, after reheating for less than 5 s, the cold-rolled steel sheet is water-cooled immediately, then an ultra-high strength martensitic cold-rolled steel sheet is obtained;

wherein the ultra-high strength martensitic cold-rolled steel sheet prepared by the ultra-rapid heating process, the yield strength is ≥1100 MPa, the tensile strength is 1800-2300 MPa, the total elongation is 12.3%, and the uniform elongation reaches only between 5.5-6%.

2. The method as recited in claim 1, wherein the ultra-rapid heating process in the step (4) is performed by electric resistance or magnetic induction channel heating.

3. The method as recited in claim 1, wherein the slab or the ingot obtained in the step (1) also contains one or more of the following elements: Ni: 0.1-3.0 wt. %, Cu: 0.5-2.0 wt. %, Nb: 0.02-0.10 wt. %, [N]: 0.002-0.25 wt. %, V: 0.02-0.35 wt. %, RE: 0.002-0.005 wt. %, and Ca: 0.005-0.03 wt. %.

* * * * *